US006199952B1

(12) United States Patent
Davis

(10) Patent No.: US 6,199,952 B1
(45) Date of Patent: Mar. 13, 2001

(54) CHAIR CONTROL GAS SPRING RETAINER FOR CHAIR HEIGHT REDUCTION

(75) Inventor: Keith L. Davis, Wilton, IA (US)

(73) Assignee: Hon Technology Inc., Muscatine, IA (US)

( * ) Notice: Subject to any disclaimer, the term of this patent is extended or adjusted under 35 U.S.C. 154(b) by 0 days.

(21) Appl. No.: 09/395,782

(22) Filed: Sep. 14, 1999

(51) Int. Cl.[7] ..... A47C 3/30
(52) U.S. Cl. ..... 297/344.19; 297/300.4
(58) Field of Search ..... 297/344.19, 300.1, 297/300.3, 300.4, 302.1, 302.2; 248/157, 218.4, 219.1

(56) References Cited

U.S. PATENT DOCUMENTS

| | | | | |
|---|---|---|---|---|
| 3,598,354 | | 8/1971 | Williams . | |
| 3,788,586 | | 1/1974 | McNally . | |
| 4,139,175 | * | 2/1979 | Bauer | 297/344.191 X |
| 4,438,978 | | 3/1984 | Arild . | |
| 4,595,237 | * | 6/1986 | Nelson | 297/344.19 |
| 4,747,640 | * | 5/1988 | Locher | 297/300.3 |
| 4,906,045 | | 3/1990 | Hofman . | |
| 5,427,434 | | 6/1995 | Hybarger | 297/344.19 |
| 5,567,012 | * | 10/1996 | Lnoblock | 297/300.48 |
| 5,630,649 | | 5/1997 | Heidmann et al. | 297/344.19 |
| 5,772,282 | | 6/1998 | Stumpf et al. . | |
| 5,810,439 | | 9/1998 | Roslund | 297/300.4 |

* cited by examiner

*Primary Examiner*—Peter R. Brown
(74) *Attorney, Agent, or Firm*—Jones, Day, Reavis & Pogue

(57) ABSTRACT

A chair control mechanism for use with a single stage gas spring construction for chair height adjustability includes a main control housing having an upwardly directed opening and an upper control housing having a downwardly directed opening. The two housings are dimensioned and configured to nest with one another and are connected by pivot members. An aperture is provided in the main control housing for receiving an end of a gas spring. A bracket assembly is welded to the main control housing and has two apertures both vertically aligned with the aperture of the main control housing and spaced above the aperture of the main control housing. The apertures of the bracket assembly are dimensioned and configured to engage a tapered end of the gas spring and support the control mechanism thereon with the end of the gas spring recessed well up into the control mechanism.

5 Claims, 6 Drawing Sheets

CHAIR CONTROL GAS SPRING RETAINER FOR CHAIR HEIGHT REDUCTION

BACKGROUND OF THE INVENTION

1. Field of the Invention

The present invention relates generally to a means for reducing the height of a chair which utilizes a gas spring fitted into the chair control for adjustability of the chair height. More particularly, the invention relates to a chair control gas spring retainer which is specifically designed to support the chair for reduced chair height as distinguished from current chair constructions.

2. Description of the Related Art

Chairs of a type suitable for use in office environments, for example, are frequently designed with manual adjustment means that permit adjustment of various chair functions. Such adjustments are typically performed by a chair control mechanism positioned beneath the chair seat and supported on a base and pedestal assembly. The adjustable functions may include, for example, chair seat and back tilt and chair height adjustment. An example of such a chair control is disclosed in U.S. Pat. No. 5,427,434 issued to Hybarger.

It is now generally accepted practice to accomplish the chair height adjustment function using a gas spring. The typical gas spring is a tubular mechanism having an internal piston and a release button on its top that can be activated by a simple lever to extend or retract a piston rod in cooperation with the weight of a user seated in the chair. The gas spring often connects directly to the chair control beneath the seat and forms part of a pedestal supported on a swivel base. Depending on the range of desired height adjustment there are generally two types of common gas spring constructions available, that is, a single stage construction and a double stage construction. The double stage construction, while it permits a wider range of height adjustment is, by virtue of its component parts, more expensive to use than a single stage spring construction. Further, with the use of certain multi-function chair controls, it has heretofore been required to use a double stage gas spring construction, according to standard chair control design, to achieve a desired range of seat height adjustability which typically ranges from between 16 inches to 20-½ inches. This is so because of the large thickness dimensions of some preferred chair control mechanisms. In this connection, one form of desired chair control mechanism comprises a first lower main housing having a generally upwardly open U-shaped configuration connected by a pivot member to a second downwardly open upper U-shaped housing. The two housings have a substantial thickness dimension to accommodate a tilt mechanism with torsion spring biasing means, for example, as well as tilt limiting and lock out means. In the typical construction of such a control mechanism, the lower housing is fitted with a collar that receives and supports the control on an upper tapered end of the gas spring. By such an arrangement, a single stage gas spring construction of a type that is generally commercially available is too long to achieve the desired range of height adjustability as heretofore mentioned. Again, the standard commercially available gas spring cannot be used with certain thicker dimensioned chair controls in a single stage arrangement of heretofore known construction because of its extended and unextended length characteristics. Thus, in such applications a more expensive double stage gas spring construction must be used. Moreover, even using a double stage gas spring construction it is desirable to provide a chair control construction that retains the spring so as to permit a greater reduction of chair height over chair designs currently available.

Accordingly, it is desirable to provide a new construction of chair control that has such desirable features as adjustable tension seat and back tilt and gas spring chair height adjustment while at the same time provides for reduced chair height as distinguished from known chairs of commercially available types. It is further desirable to provide such a control which is readily manufacturable by known techniques. Still further, it is desirable to provide such a control which is cost-effective to manufacture.

SUMMARY OF THE INVENTION

The present invention improves over the prior art by providing a chair control mechanism for use with a gas spring construction for chair height adjustability. The mechanism includes a main control housing having an upwardly directed opening and an upper control housing having a downwardly directed opening. The two housings are dimensioned and configured to nest with one another and are connected by a pivot member. An aperture is provided in the main control housing for receiving an end of a gas spring. A bracket assembly is welded to the main control housing and has two apertures both above and vertically aligned with the aperture of the main control housing. The apertures of the bracket assembly are spaced above the aperture of the main control housing and are dimensioned and configured to engage a tapered end of the gas spring and support the control mechanism thereon. By supporting the control with the gas spring retained well up in the control, greater reduction of chair height is achieved.

BRIEF DESCRIPTION OF THE DRAWINGS

The foregoing and other novel features and advantages of the invention will be better understood upon a reading of the following detailed description taken in conjunction with the accompanying drawings wherein.

DETAILED DESCRIPTION OF THE PREFERRED EMBODIMENT

Figure 1:
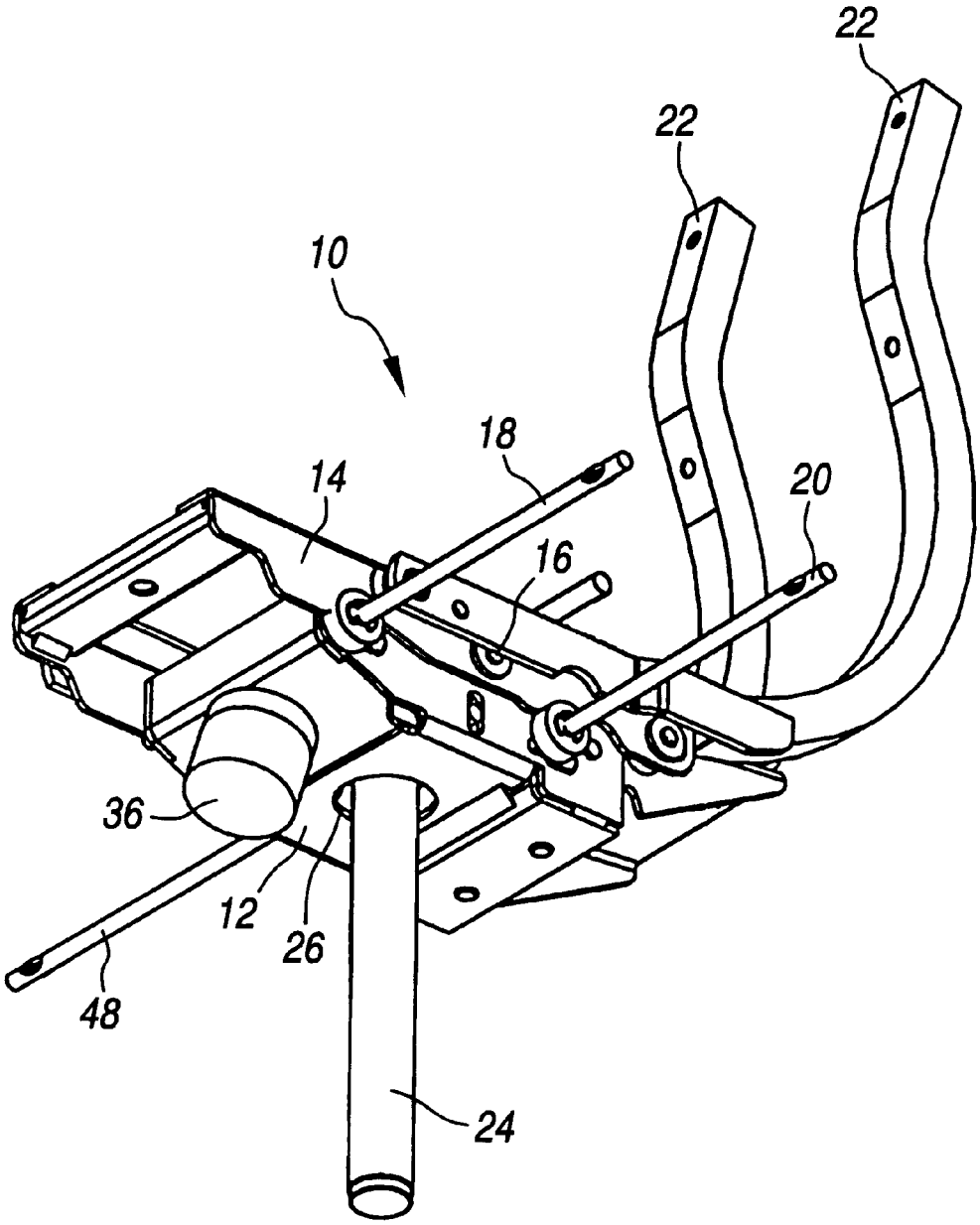
FIG. 1 is a bottom side perspective view of a chair control suitable for practicing the principles of the present invention.

Referring now to drawings, and initially to FIG. 1, a chair control of a type suitable for practicing the principles of the invention is designated generally by the reference numeral 10 and includes as its principle components a lower main housing 12 having an upwardly directed opening and an upper housing 14 having a downwardly directed opening. A chair seat (not shown) can be attached by suitable fasteners to the upper housing 14. The housings 12 and 14 are dimensioned and configured such that the lower housing 12 nests within the upper housing 14 and the housings 12 and 14 are pivotably connected by a pair of opposed pins 16, only one of which can be seen. The illustrated control 10 is designed with an adjustable forward tilt limiter 18 and an adjustable rearward tilt limiter 20. Suitable back supports 22 extend from the control 10. A gas spring 24 extends into the control 10 through an oversized aperture 26 in the lower housing 12.

Figure 2:
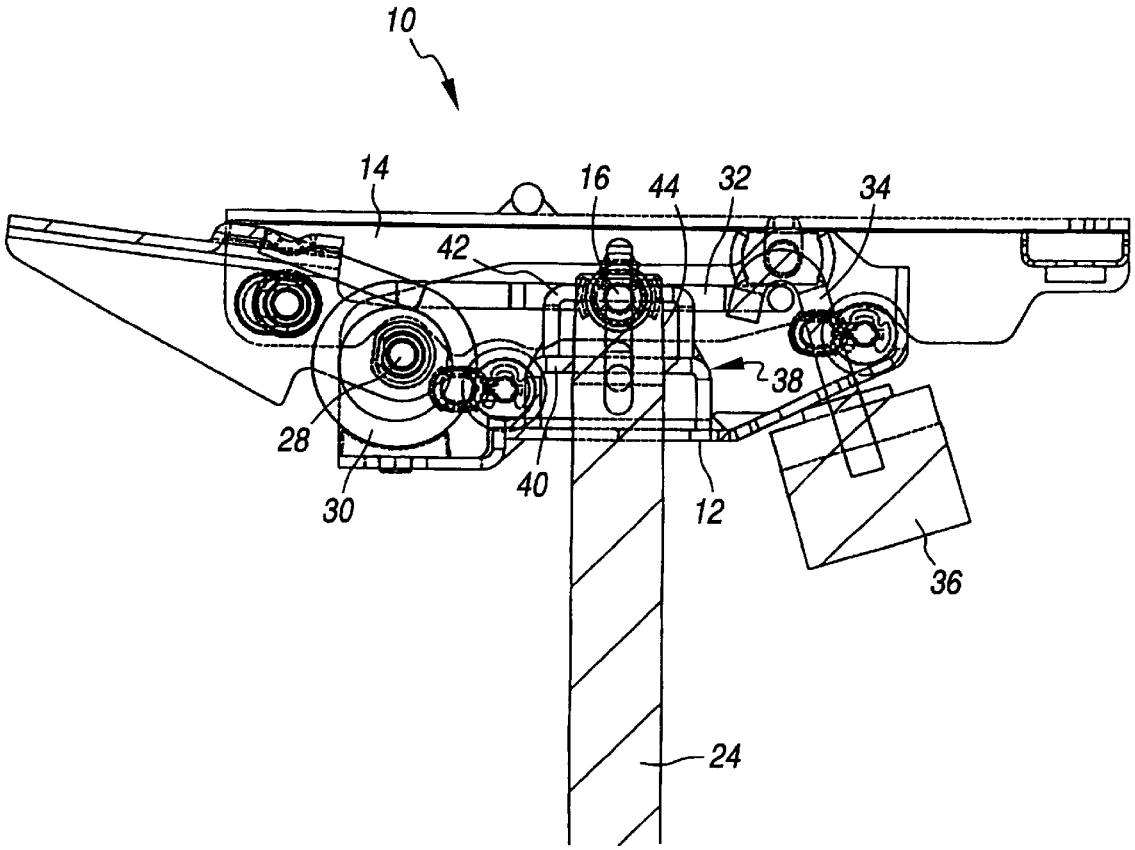
FIG. 2 is a partial side cross-sectional view of the chair control of FIG. 1.

Turning now to FIG. 2, an adjustable feature of the control 10 can be seen. Disposed around a pivot shaft 28 is a torsion spring 30. In a manner well known in the art, a forwardly extended arm 32 of the spring 30 is engaged by a hook member 34 that, in turn, is threadedly received by a knob 36. By turning the knob 36, the tension of the rearward tilting of the associated chair seat (not shown) can be adjusted. In accordance with the invention a bracket assembly 38 consisting of a lower generally U-shaped bracket member 40 and an upper generally U-shaped bracket member 42 are attached as by welding to the lower control housing 12 at a position centered over the aperture 26. The bracket members 40 and 42 each have a central aperture suitably dimensioned to frictionally receive and engage an upper tapered end 44 of the gas spring 24.

Figure 3:
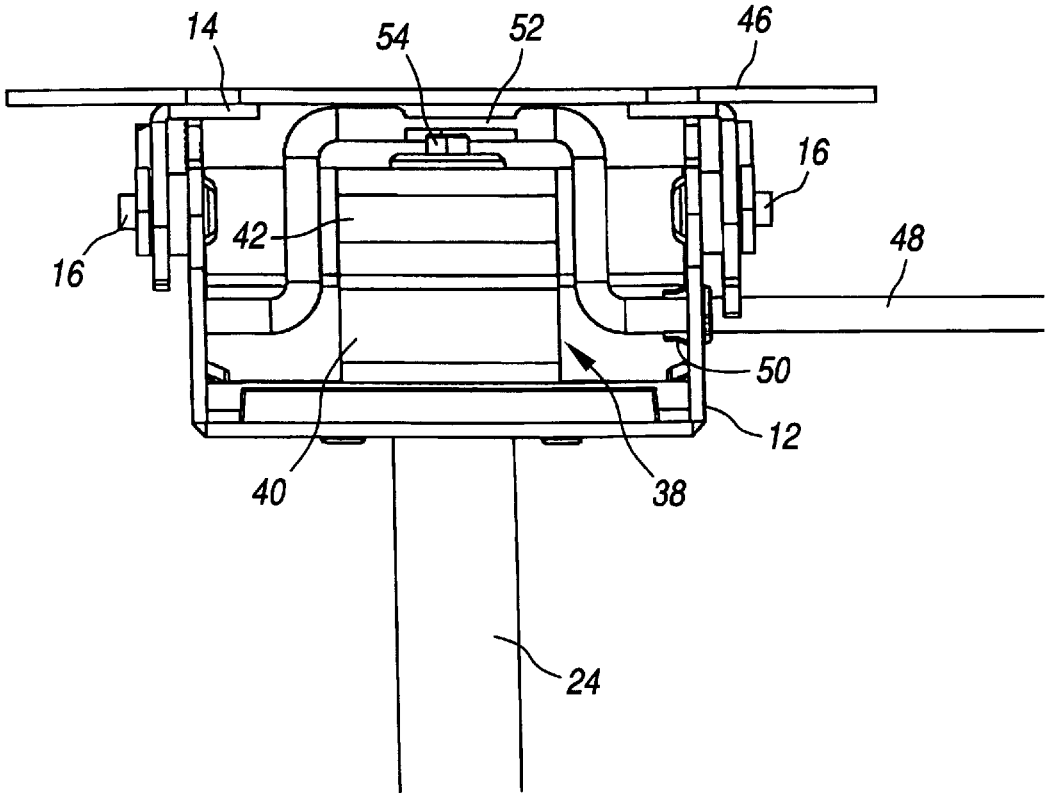
FIG. 3 is a partial rear cross-sectional view of the chair control of FIG. 1.

FIG. 3 illustrates a partial cross-sectional view of the control 10 as viewed from the rear showing the control attached to a seat pan 46. In this view a manually actuatable lever 48 can be seen as pivotably mounted on the lower housing 12 and retained by a plug 50. Lifting upwardly on the lever 48 causes an intermediate portion 52 of the lever to depress an actuating button 54 at the top of the gas spring 24 thereby releasing air from the spring 24 and causing the chair seat to lower under weight of the occupant.

Figure 4:
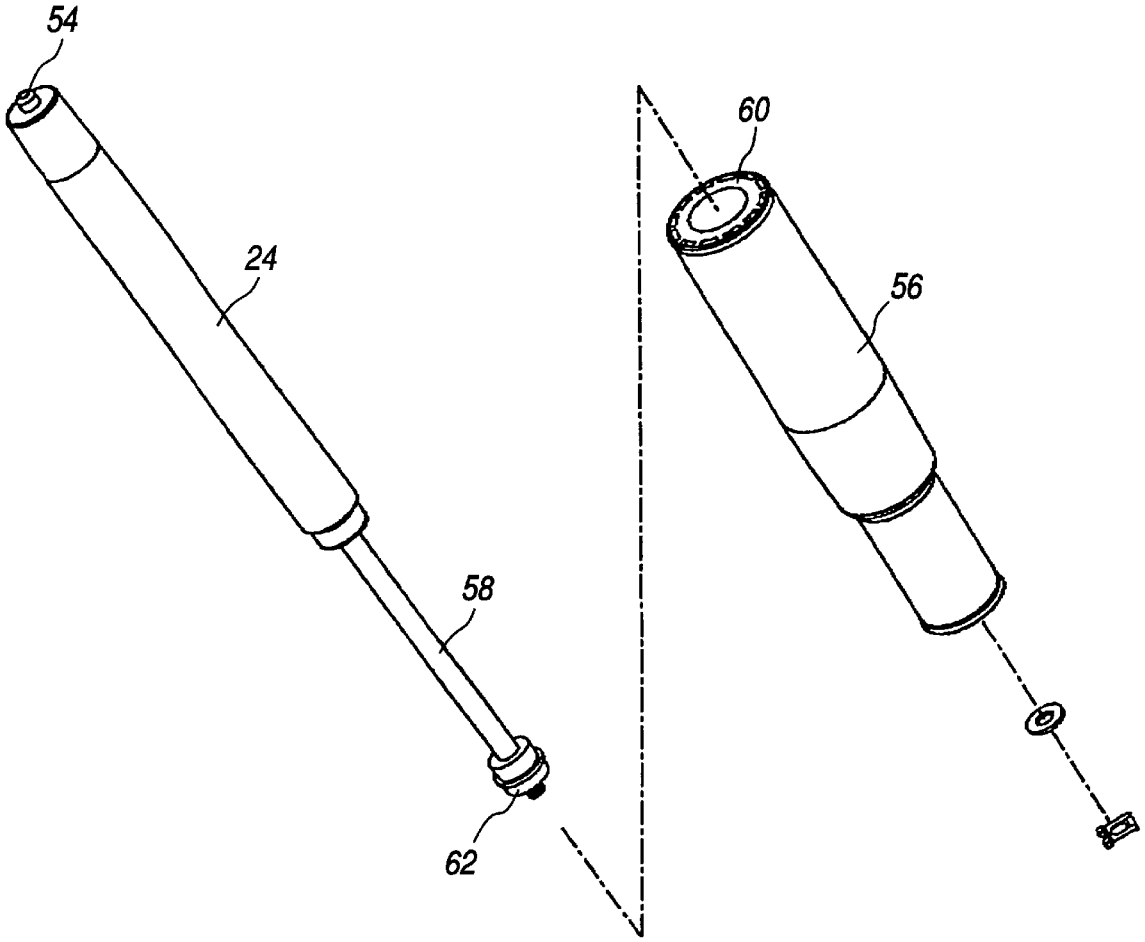
FIG. 4 ( PRIOR ART )
FIG. 4 is an exploded perspective view illustrating a conventional single stage gas spring construction.

FIG. 4 illustrates an exploded view of a conventional gas spring 24, shown as insertable into a stand pipe 56 that comprises the pedestal of a chair and is of single stage construction. The spring 24, in a manner well-known in the art, is made with a push rod 58 connected at an end internal to the spring 24 to a piston (not shown). A release button 54 is manually actuateable by a lever, such as lever 48 shown in FIG. 3, to allow air to escape the spring 24 and let the rod 58 retract. The stand pipe 56 which may be press fit or welded to a chair base has a plastic liner 60 which slidingly receives the spring 24. A suitable thrust washer 62 may be provided to permit rotation of the stand pipe 56 about the spring 24.

Figure 5:
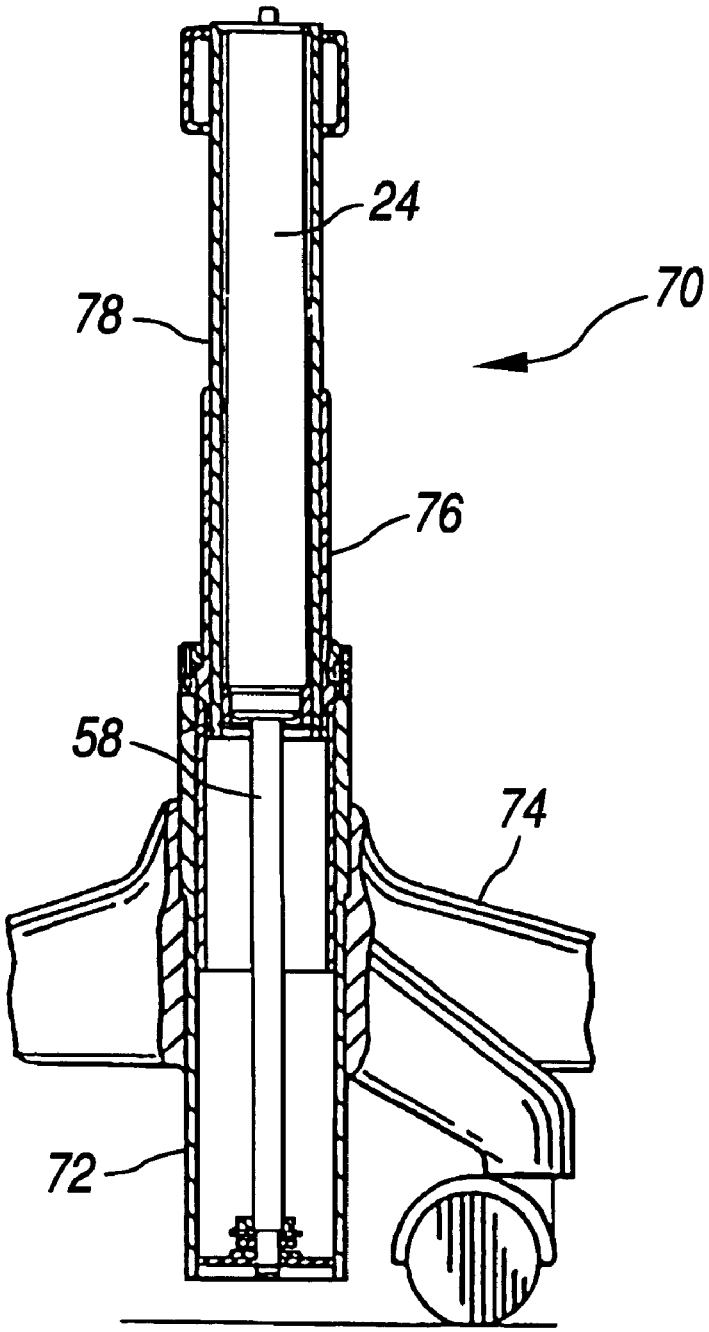
FIG. 5 ( PRIOR ART )
FIG. 5 is a cross-sectional view illustrating a conventional double stage gas spring construction.

Illustrated in FIG. 5 is a cross-sectional view of a conventional gas spring assembly 70 that is of a double stage type. The assembly 70 includes an outer guide tube 72 mounted to a chair base 74. An intermediate telescoping tube 76 is slidingly positioned within tube 72. An inner telescoping tube 78 is slidably positioned within the intermediate tube 76. To adjust the vertical position of the chair a conventional gas spring 24 is mounted within the inner tube 78 with a piston rod 58 extending from the spring 24.

It can now be appreciated that a chair control constructed according to the principles of the invention offers considerable advantages over prior art controls. Instead of using a collar like member extending downwardly from a lower control housing to receive the upper end of a gas spring such as is common in the prior art and as is taught by the aforementioned Hybarger patent, the control 10 of the instant invention is specifically designed to have a bracket assembly 38 for supporting a cylinder that is recessed well up into the chair control 10. This construction readily allows for the economical use of a single stage gas cylinder construction, as opposed to a double stage construction while still allowing for a chair height adjustment within a generally accepted range of movement. Further, where double stage gas spring construction is desired, the bracket assembly 38 by virtue of its recessed arrangement permits even greater reduction in the height of the chair. It can further be appreciated that the simple design of the present bracket assembly 38 also allows for cost effective manufacture of the disclosed chair control 10. While the bracket assembly 38 is shown as comprising two members 40 and 42, it will be appreciated that a single member may be used by suitable die casting or plastic molding techniques.

Figure 6:
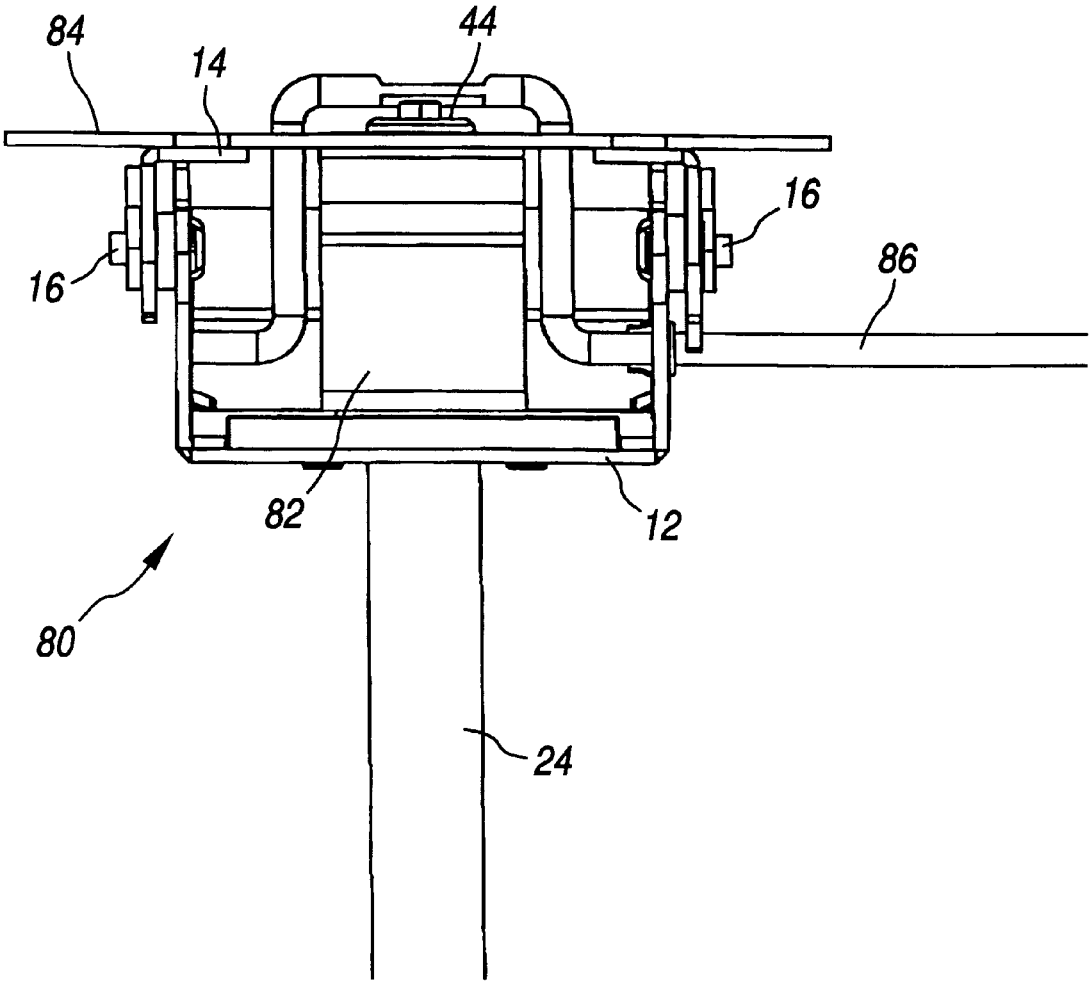
FIG. 6 is a partial rear cross-sectional view of an alternative chair control construction.

A further advantage of the invention can be appreciated with reference to FIG. 6. When it is desired to provide for even greater chair height reduction over both the prior art as well as over the reduction that is possible with the control 10 construction as heretofore described, a control 80 may be employed. In this construction a bracket assembly 82 having increased height as distinguished from bracket assembly 38 is provided which allows the end 44 of the gas spring 24 to project up through a central cut-out region of the seat pan 84. A suitable modified actuator lever 86 may be provided like the lever 48 shown in FIG. 3 to actuate the gas spring button 54. In this construction, the seat pan 84 can be suitably upholstered to accommodate the lever 86 and end 44 of the gas spring 24.

While the invention has been described in connection with preferred embodiments thereof, it will be apparent to those skilled in the art that many changes and modifications may be made without departing from the true spirit and scope of the present invention. Accordingly, it is intended by the appended claims to cover all such changes and modifications as come within the spirit and scope of the invention.

What is claimed is:

1. A control mechanism for a chair utilizing a gas spring construction for chair height adjustability, the mechanism comprising:

a main control housing having an upwardly directed opening;

an upper control housing having a downwardly directed opening and being dimensioned and configured to nest with said main control housing;

pivot means for pivotably connection said main control housing to said upper control housing;

an aperture in said main control housing which receives an upper portion of a gas spring and to allow said portion to pass through said main control housing;

a bracket means disposed on said main control housing and having two apertures both vertically aligned with the aperture of the main control housing;

said apertures of said bracket means being spaced above the aperture of said main control housing and being dimensioned and configured to engage a tapered end of said gas spring and support said control mechanism thereon;

wherein an upper end of said gas spring is positionable in closely spaced relation to said upper control housing when said tapered end of said gas spring is engaged by said apertures of said bracket.

2. The mechanism of claim 1 wherein said bracket means comprises two generally U-shaped bracket members.

3. The mechanism of claim 2 wherein each of said bracket members has an aperture for receiving said tapered end of said gas spring.

4. The mechanism of claim 1 wherein a seat attached to said mechanism is adjustable in height through a range of between about 16 and 20-½ inches.

5. A control mechanism for a chair utilizing a gas spring construction for chair height adjustability the mechanism comprising:

a main control housing having an upwardly directed openings;

an upper control housing having a downwardly directed opening and being dimensioned and configured to nest with said main control housing;

pivot means for pivotably connection said main control housing to said upper control housing;

an aperture in said main control housing which receives an upper portion of a gas spring and to allow said portion to pass through said main control housing;

a bracket means disposed on said main control housing and having two apertures both vertically aligned with the aperture of the main control housing;

said apertures of said bracket means being spaced above the apertures of said main control housing and being dimensioned and configured to engage a tapered end of said gas spring and support said control mechanism thereon;

wherein the bracket means is dimensioned and configured to allow the tapered end of the gas spring to extend through a cut-out region of a seat pan attached to the upper control housing.

* * * * *